US007173189B1

(12) United States Patent
Hazy et al.

(10) Patent No.: US 7,173,189 B1
(45) Date of Patent: Feb. 6, 2007

(54) CONCENTRIC MULTI-PAIR CABLE WITH FILLER

(75) Inventors: Lewis Hazy, Sidney, NE (US); Erich Sawyer, Sidney, NE (US); Jeff Stutzman, Sidney, NE (US); Federick W. Johnston, Dalton, NE (US); Spring Stutzman, Sidney, NE (US); Dave Wiekhorst, Potter, NE (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/268,681

(22) Filed: Nov. 4, 2005

(51) Int. Cl.
*H01B 7/00* (2006.01)

(52) U.S. Cl. ..... 174/110 R; 174/113 R; 174/113 C

(58) Field of Classification Search ..... 174/36, 174/110 R, 113 R, 113 C, 115, 116, 27
See application file for complete search history.

(56) References Cited

U.S. PATENT DOCUMENTS

| | | | | | |
|---|---|---|---|---|---|
| 3,025,656 | A | | 3/1962 | Cook | |
| 3,187,495 | A | | 6/1965 | Christian, Jr. | |
| 3,324,233 | A | | 6/1967 | Bryant | |
| 3,546,357 | A | * | 12/1970 | Windeler et al. | 174/34 |
| 3,584,132 | A | * | 6/1971 | Brauns et al. | 174/34 |
| 3,678,177 | A | * | 7/1972 | Lawrenson | 174/113 C |
| 4,263,471 | A | * | 4/1981 | Bauguion | 174/34 |
| 4,372,105 | A | | 2/1983 | Ellis, Jr. | |
| 4,408,443 | A | * | 10/1983 | Brown et al. | 57/204 |
| 4,654,476 | A | | 3/1987 | Barnicol-Ottler et al. | |
| 4,697,051 | A | * | 9/1987 | Beggs et al. | 178/63 D |
| 4,755,629 | A | | 7/1988 | Beggs et al. | |
| 5,323,596 | A | | 6/1994 | Nguyen | |
| 5,418,878 | A | | 5/1995 | Sass et al. | |
| 5,544,270 | A | | 8/1996 | Clark et al. | |
| 5,689,090 | A | * | 11/1997 | Bleich et al. | 174/121 A |
| 5,767,441 | A | * | 6/1998 | Brorein et al. | 174/27 |
| 5,814,768 | A | * | 9/1998 | Wessels et al. | 174/110 FC |
| 5,821,466 | A | | 10/1998 | Clark et al. | |
| 5,883,334 | A | * | 3/1999 | Newmoyer et al. | 174/113 R |
| 5,936,205 | A | * | 8/1999 | Newmoyer | 174/113 R |
| 5,952,615 | A | * | 9/1999 | Prudhon | 174/113 C |
| 5,969,295 | A | * | 10/1999 | Boucino et al. | 174/113 C |
| 6,259,031 | B1 | | 7/2001 | Totland et al. | |
| 6,288,340 | B1 | * | 9/2001 | Arnould | 174/113 R |
| 6,365,836 | B1 | * | 4/2002 | Blouin et al. | 174/113 C |
| 6,506,976 | B1 | * | 1/2003 | Neveux, Jr. | 174/113 R |
| 6,529,031 | B2 | * | 3/2003 | Gerstmeier et al. | 324/769 |
| 6,639,152 | B2 | * | 10/2003 | Glew et al. | 174/113 C |
| 6,800,811 | B1 | * | 10/2004 | Boucino | 174/113 C |

(Continued)

FOREIGN PATENT DOCUMENTS

| | | |
|---|---|---|
| JP | HEI 6-349344 | 12/1994 |

OTHER PUBLICATIONS

Krone Product Data Sheet, Issue Date: Jan. 16, 2001, 1 page.

*Primary Examiner*—William H. Mayo, III
(74) *Attorney, Agent, or Firm*—Merchant & Gould P.C.

(57) ABSTRACT

A cable including a first group of inner twisted conductor pairs and a second group of outer twisted conductor pairs. The first group of inner pairs is twisted at a first twist rate, the second group of outer pairs is twisted at a second twist rate.

37 Claims, 2 Drawing Sheets

U.S. PATENT DOCUMENTS

| | | | | |
|---|---|---|---|---|
| 6,818,832 | B2 * | 11/2004 | Hopkinson et al. | 174/113 R |
| 6,958,444 | B1 | 10/2005 | Chou | |
| 2003/0106704 | A1 * | 6/2003 | Isley et al. | 174/113 R |
| 2003/0132021 | A1 * | 7/2003 | Gareis | 174/113 C |
| 2003/0168228 | A1 | 9/2003 | Eichelberger et al. | |
| 2003/0230427 | A1 * | 12/2003 | Gareis | 174/113 C |
| 2004/0040736 | A1 | 3/2004 | Nishimura | |
| 2004/0149483 | A1 | 8/2004 | Glew | |
| 2004/0149484 | A1 | 8/2004 | Clark | |
| 2005/0045367 | A1 * | 3/2005 | Somers et al. | 174/113 R |
| 2005/0061536 | A1 | 3/2005 | Proulx | |
| 2005/0103518 | A1 | 5/2005 | Glew | |
| 2005/0199415 | A1 | 9/2005 | Glew | |
| 2005/0199416 | A1 | 9/2005 | Somers et al. | |
| 2005/0279528 | A1 * | 12/2005 | Kenny et al. | 174/113 R |

* cited by examiner

CONCENTRIC MULTI-PAIR CABLE WITH FILLER

TECHNICAL FIELD

The present disclosure relates generally to devices for use in the telecommunications industry, and various methods associated with such devices. More particularly, this disclosure relates to a telecommunications cable having an arrangement of twisted conductor pairs.

BACKGROUND

A wide variety of cable arrangements having twisted conductor pairs are utilized in the telecommunication industry. The increased need for high-speed communication transmissions (e.g., high-speed data transmissions) has placed a greater demand on twisted conductor pair systems. In general, improvement has been sought with respect to existing cable technology for use with such systems, generally to better accommodate the increasing volume of data transmissions and accommodate the increased capacity demands of such systems.

SUMMARY

One aspect of the present disclosure relates to a cable having a first group of inner twisted conductor pairs and a second group of outer twisted conductor pairs. The first group of pairs is twisted at a first twist rate; the second group of pairs is twisted at a second twist rate. Another aspect of the present disclosure relates to a method of manufacturing a cable having first and second groups of twisted conductor pairs that are twisted at different twist rates.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
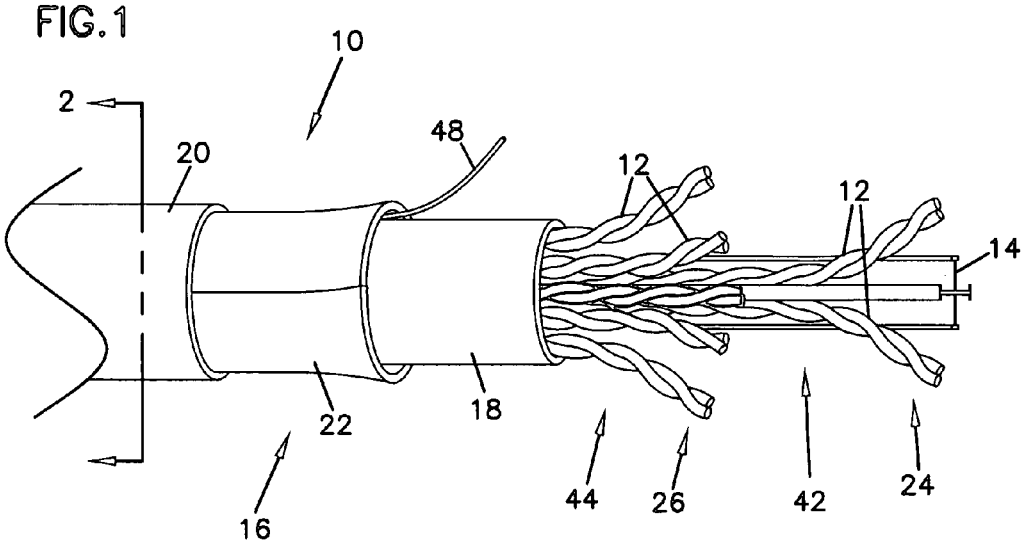
FIG. 1 is a perspective view of a multi-pair cable, according to the principles of the present disclosure.

FIG. 1 illustrate a multi-pair cable 10 having features that are examples of how inventive aspects in accordance with the principles of the present disclosure may be practiced. Preferred features of the disclosed multi-pair cable are adapted for increasing the volume or number of data transmissions carried over the cable in comparison to conventional cables; and thereby increasing the capacity of communication applications utilizing the disclosed multi-pair cable.

Figure 2:
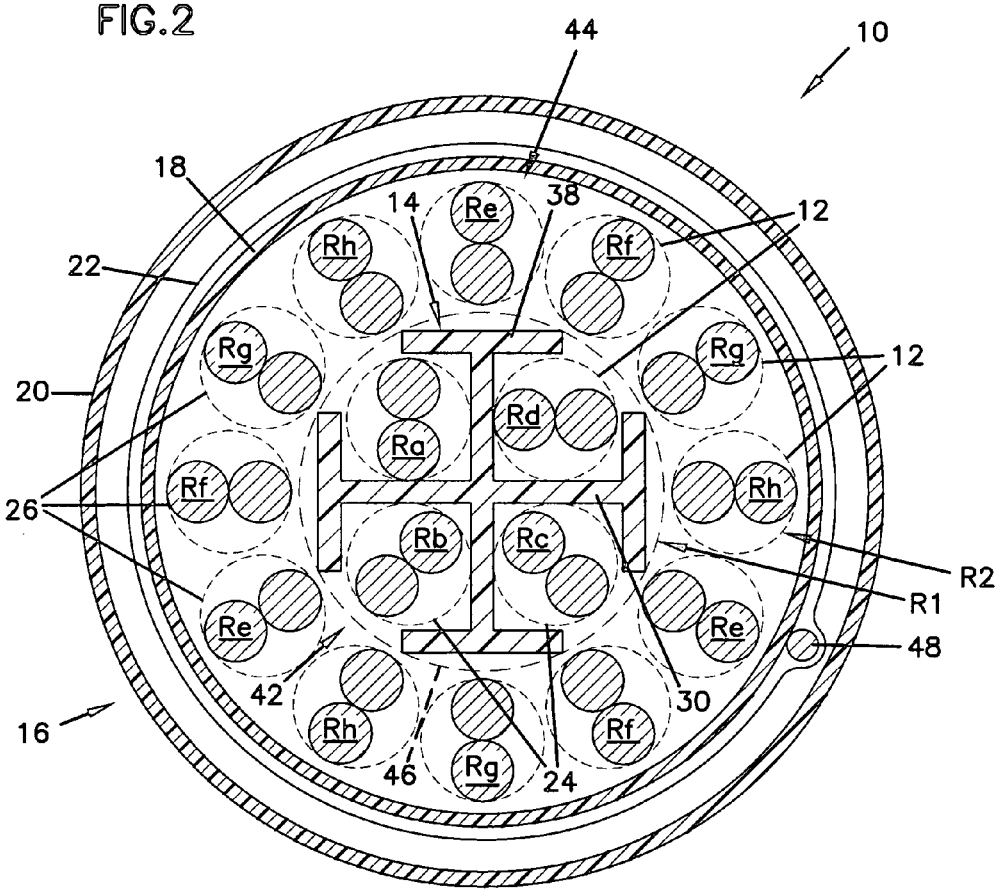
FIG. 2 is schematic, cross-sectional view the multi-pair cable of FIG. 1, taken along line 2—2, showing a filler and a plurality of twisted conductor pairs.

Referring to FIGS. 1 and 2, the cable 10 of the present disclosure includes a plurality of twisted conductor pairs 12 surrounded or covered by a jacket 16. The twisted conductor pairs 12 include two insulated conductors twisted about one another along a longitudinal axis.

In the illustrated embodiment, the jacket 16 of the cable 10 includes a first inner jacket layer 18 and a second outer jacket layer 20. A metal layer 22 is disposed between the inner jacket layer 18 and the outer jacket layer 20. The metal layer 22 provides shielding to protect the twisted conductor pairs 12 from interference that can adversely affect signal transmissions through the cable, such as electromagnetic radiation. The inner jacket layer 18 separates the twisted conductor pairs 12 from the shielding or metal layer 22. In the illustrated embodiment, a drain wire 48 is provided to ground or terminate the shield or metal layer 22 of the jacket 16.

In one embodiment, the inner jacket layer 18 and the outer jacket layer 20 are made of a non-conductive material such as polyvinyl chloride (PVC), for example. Other types of non-conductive materials can be used for one or both of the jacket layers. The metal layer 22 is preferably made of a shielding material, such as aluminum, for example. Other types of materials and/or constructions adapted for blocking electromagnetic radiation, such as a copper foil tape or screen, a metallic braid shield, or a corrugated metal shield can also be used in accordance with the principles disclosed.

Referring to FIG. 2, the twisted conductor pairs 12 of the cable 10 are arranged in groupings of twisted pairs, including a first grouping of inner twisted conductor pairs 24 and a second grouping of outer twisted conductor pairs 26. In the illustrated embodiment, the first grouping includes four inner twisted conductor pairs 24, and the second grouping includes twelve outer twisted conductor pairs 26. The illustrated multi-pair cable 10 is accordingly a 16-pair cable.

Figure 3:
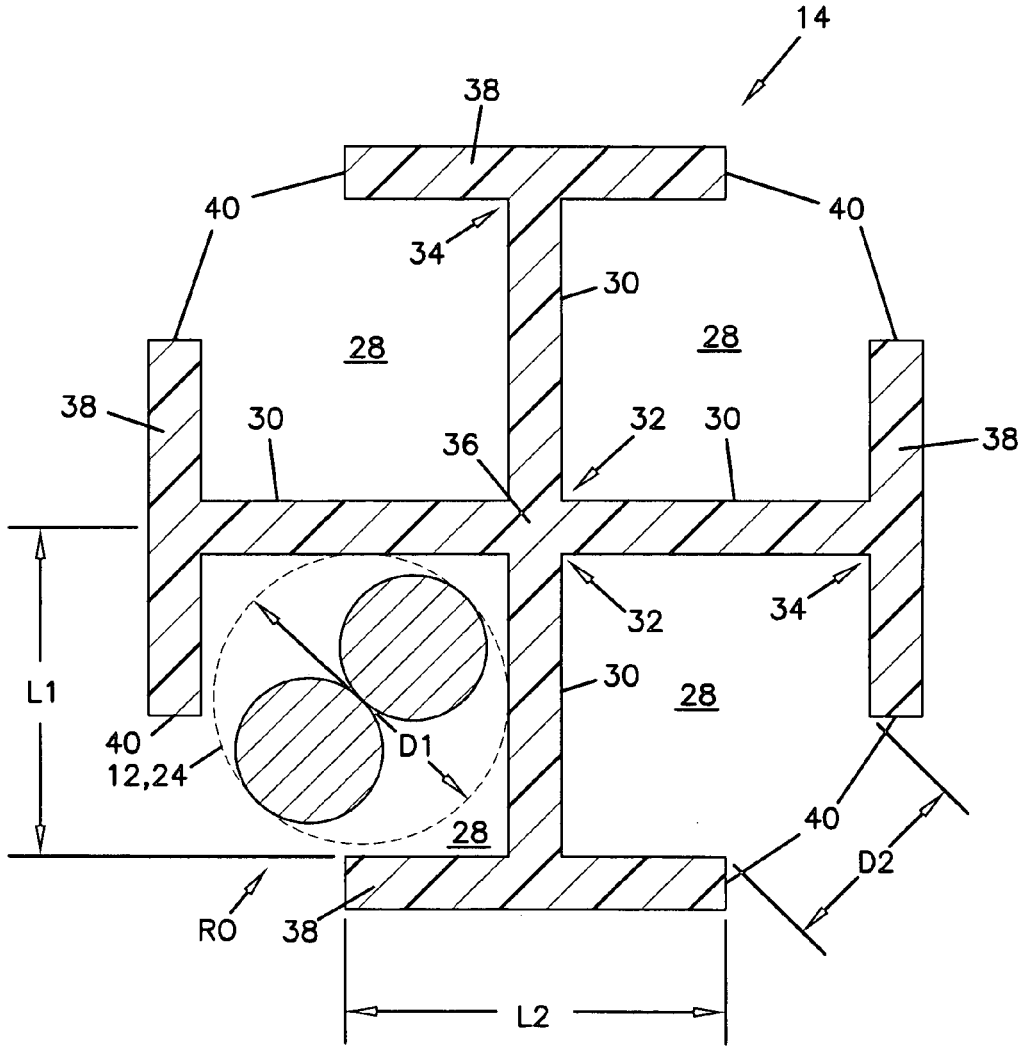
FIG. 3 is a cross-sectional view of the filler of FIG. 2, shown in isolation and with only one twisted conductor pair.

As shown in FIGS. 1–3, the multi-pair cable 10 further includes a filler 14. The filler 14 defines a number of pockets 28 (FIG. 3). Each of the inner twisted conductor pairs 24 is positioned with one of the number of pockets 28. In the illustrated embodiment, the filler 14 has four pockets 28 defined by radial extensions 30. The radial extensions 30 separate each of the inner twisted conductor pairs 24 from the other inner twisted conductor pairs.

Referring to FIG. 3, the radial extensions 30 of the filler 14 each have a first end 32 and a second end 34. The first ends 32 of the radial extensions 30 are joined and define a center 36 of the filler 14. The second ends 34 are free ends. Each of the radial extensions 30 has a length L1 that extends from the first end 32 or center 36 to the free end 34. The length L1 of the radial extensions 30 is preferably greater than a diameter D1 of the inner twisted conductor pairs 24.

Still referring to FIG. 3, the filler 14 also includes retaining members 38 located at the free ends 34 of the radial extension 30. The retaining members 38 are arranged and configured to retain the inner twisted conductor pairs 24 within the pockets 28 of the filler 14 (FIG. 2). In particular, each of the retaining members 38 has a length L2. The retaining members 38 are oriented such that the length L2 of the retaining member 38 is transverse to the length L1 of the respective radial extension 30. The length L2 is provided so that adjacent end portions 40 of adjacent retaining members 38 contain or hold the inner twisted conductor pair 24 within the pocket 28 of the filler.

That is, a distance D2 between adjacent end portions 40 of adjacent retaining members 38 is less than the diameter D1 of the inner twisted conductor pair 24. One or both of the retaining members 38 and the radial extensions 30 is therefore, preferably, made of a material that flexes to permit placement of the inner twisted conductor pair 24 within the pockets 28. In one embodiment, the filler 14, i.e., the radial extensions 30 and the retaining members 38 are made of a non-conductive material. Other materials can be used to manufacture the filler 14 in accordance with the principles disclosed. Because the distance D2 between the end portions 40 of the retaining members 38 is less than the diameter D1 of the inner twisted conductor pairs 24, the pairs 24 are retained within the pockets 28 of the filler 24.

In addition to retaining and separating the inner twisted conductor pairs 24, the filler 14 also functions to space or provide separation between the first grouping of inner twisted conductor pairs 24 and the second grouping of outer conductor pairs 26 (see FIG. 2). In particular, the length L1 of the radial extensions 30 is greater than the diameter D1 of the inner twisted conductor pairs 24 such that the retaining members 38 and radial extensions 30 provide a separation between the two groupings of twisted conductor pairs.

Referring again to FIG. 2, the grouping of inner twisted conductor pairs 24 positioned within the pockets 28 of the filler 14 defines an inner core 42 of the cable 10. As can be understood from the preceding description, the inner core 42 has a circumference 46 generally defined by the radial extensions 30 and the retaining members 38 of the filler 14. The grouping of outer twisted conductor pairs 26 surrounds the inner core 42 and defines a concentric outer layer 44 of twisted conductor pairs. The outer twisted conductor pairs 26 of the outer layer 44 are spaced at approximately equal intervals about the circumference 46 of the inner core 42. The jacket 16, including the inner jacket layer 18, the metal layer 22, and the outer jacket layer 20, covers the inner core 42 and the outer layer 44 of twisted conductor pairs.

Preferably, the inner core 42 of the multi-pair cable 10 is twisted at a first twist rate R1. The first twist rate R1 is the rate at which both of the filler and the first grouping of inner twisted conductor pairs 24 are turned or twisted in unison about a central axis of the filler or inner core. In one embodiment, the first twist rate R1 is approximately 4.8 twists per linear foot. In addition, each of the inner twisted conductor pairs 24 of the inner core 42 has an individual conductor twist rate Ra, Rb, Rc, Rd. The individual conductor twist rate Ra, Rb, Rc, Rd of each of the inner twisted conductor pairs 24 is preferably different from the individual conductor twist rates of the other inner twisted conductor pairs. In one embodiment, the individual conductor twist rates Ra, Rb, Rc, Rd of the inner twisted conductor pairs are between about 27.3 twists per linear foot and 36.8 twists per linear foot.

While the inner core 42 is twisted at the first twist rate R1, the outer layer 44 is preferably twisted at a second twist rate R2 that is different than the first twist rate R1 of the inner core 42. The second twist rate R2 is the rate at which all of the outer twisted conductor pairs 26 are turned or twisted in unison about a central axis of the cable or outer layer. In one embodiment, the second twist rate R2 is approximately 1.333 twists per linear foot of cable. In addition, each of the outer twisted conductor pairs 26 of the outer layer 44 has an individual conductor twist rate Re, Rf, Rg, Rh. In the illustrated embodiment, the twelve outer twisted conductor pairs 26 preferably have one of four different conductor twist rates Re, Rf, Rg, Rh, and are arranged in a sequence as shown in FIG. 2 according to the particular individual conductor twist rate.

Preferably, each of the individual twist rates Re, Rf, Rg, Rh of the outer twisted conductor pairs 26 is outside the range of twist rates Ra, Rb, Rc, Rd (27.3 to 36.8 twists per foot) of the inner twisted conductor pairs 24. By this arrangement, the orientation of each of the inner twisted conductor pairs 24 is non-parallel to the orientation of the outer twisted conductor pairs 26 to reduce the likelihood of crosstalk. More preferably, each of the individual twist rates Re, Rf, Rg, Rh of the outer twisted conductor pairs 26 is less than each of the individual twist rates Ra, Rb, Rc, Rd of the inner twisted conductor pairs 24. In one embodiment, the individual conductor twist rates Re, Rf, Rg, Rh of the outer twisted conductor pairs 26 are between about 12.4 twists per linear foot and 27.0 twists per linear foot.

To manufacture the disclosed multi-pair cable 10, the inner twisted conductor pairs 24 are positioned within the pockets 28 of the filler 14. As previously discussed, each of the inner twisted conductor pairs 24 preferably has an individual conductor twist rate that is different from the individual conductor twist rates of the other inner twisted conductor pairs. The filler 14 and the inner twisted conductor pairs 24 (i.e., the inner core 42) are then twisted, in unison about the central axis of the filler 14, at an initial twist rate R0 (FIG. 3—showing only one twisted conductor pair 24 for purposes of clarity). In one embodiment, the initial twist rate R0 is approximately 4 twists per linear foot of cable.

As can be understood, because each of the inner twisted conductor pairs 24 is already twisted at a particular individual conductor twist rate, the individual conductor twist rates of the inner twisted conductor pairs 24 change when the entire inner core 42 is twisted. Preferably, each of the inner twisted conductor pairs 24 has the same direction of twist (e.g. a right-hand twist or a left-hand twist) as the direction in which the inner core 42 is initially twisted. By this, the individual conductor twist rates of the inner twisted conductor pairs 24 increase as the inner core 42 is twisted.

After the inner core 42 has been twisted at the initial twist rate R0, the second grouping of outer twisted conductor pairs 26 are positioned concentrically about the circumference 46 of the inner core 42. The outer layer 44 and the inner core 42 are then twisted at the second twist rate R2 previously described (i.e. the outer twisted conductor pairs 26, the filler 14, and the inner twisted conductor pairs 24 are twisted in unison about the central axis of the cable or filler at the second twist rate). As can be understood, because each of the outer twisted conductor pairs 26 is already twisted at a particular individual conductor twist rate, the individual conductor twist rates of the outer twisted conductor pairs 26 change when the outer layer 44 is twisted. Preferably, each of the outer twisted conductor pairs 26 has the same direction of twist (e.g. a right-hand twist or a left-hand twist) as the direction in which the outer layer 44 is twisted. By this, the individual conductor twist rates of the outer twisted conductor pairs 26 increase as the outer layer 44 is twisted. The resulting individual conductor twist rates of each of the outer twisted conductor pairs 26 are the twist rates Re, Rf, Rg, and Rh previously described.

When the outer layer 44 is twisted at the second twist rate R2, the inner core 42 also twists in unison with the outer layer 44. Preferably, each of the inner core 42 and the outer layer 44 has the same direction of twist. By this, the twist rate of the inner core 42, and accordingly the twist rates of the inner twisted conductor pairs 24, increase as the outer layer 44 is twisted. The resulting twist rate of the inner core 42 is the first twist rate R1 previously described. Likewise, the resulting individual conductor twist rates of each of the inner twisted conductor pairs 24 are the twist rates Ra, Rb, Rc, and Rd previously described.

The above specification provides a complete description of the invention. Since many embodiments of the invention can be made without departing from the spirit and scope of the invention, certain aspects of the invention reside in the claims hereinafter appended.

What is claimed is:

1. A cable, comprising:

a) a first grouping of twisted conductor pairs, the first grouping of twisted conductor pairs including twisted conductor pairs each having different individual twist rates, each of the twisted conductor pairs being twisted in the same direction, the direction being only one of a right-handed twist direction and a left-handed twist direction, the first grouping defining an inner core, the inner core being twisted at a first twist rate, the inner core being twisted in the same direction as the twisted conductor pairs; and b) a second grouping of twisted conductor pairs, the second grouping defining an outer layer of twisted conductor pairs that surrounds the inner core, the outer layer being twisted at a second twist rate, the second twist rate of the outer layer being different than the first twist rate of the inner core, the outer layer being twisted in the same direction as the inner core.

2. The cable of claim 1, wherein the first grouping of twisted conductor pairs includes four twisted conductor pairs.

3. The cable of claim 1, wherein the second grouping of twisted conductor pairs includes twisted conductor pairs having individual twist rates, the individual twist rates of each of the twisted conductor pairs of the second grouping being greater than the different individual twist rates of each of the twisted conductor pairs of the first grouping.

4. The cable of claim 3, wherein each of the twisted conductor pairs of the second grouping are individually twisted in the same direction, the direction being only one of a right-handed twist direction and a left-banded twist direction.

5. The cable of claim 3, wherein each of the individual twist rates of the twisted conductor pairs of the second grouping is between about 12.4 twists per linear foot and 27.0 twists per linear foot.

6. The cable of claim 1, wherein the second grouping of twisted conductor pairs includes twelve twisted conductor pairs.

7. The cable of claim 6, wherein each one of the twelve twisted conductor pairs of the second grouping has one of four different twist rates.

8. The cable of claim 1, wherein the second grouping of twisted conductor pairs includes twisted conductor pairs having different individual twist rates than other twisted conductor pairs of the second grouping.

9. The cable of claim 1, wherein the inner core further includes a filler, the twisted conductor pairs of the first grouping being positioned within pockets defined by the filler.

10. The cable of claim 1, further including a jacket that covers the first and second groupings of twisted conductor pairs.

11. The cable of claim 10, wherein the jacket includes a metal layer for shielding the cable from interference that can affect signal transmissions through the cable.

12. The cable of claim 11, wherein the jacket includes an inner jacket layer and an outer jacket layer, the metal layer being positioned between the inner jacket layer and the outer jacket layer.

13. The cable of claim 1, wherein the second grouping of twisted conductor pairs are spaced at approximately equal intervals about a circumference of the inner core.

14. The cable of claim 1, wherein each of the different individual twist rates of the twisted conductor pairs of the first grouping is between about 27.3 twists per linear foot and 36.8 twists per linear foot.

15. The cable of claim 1, wherein the first twist rate of the inner core is approximately 4.8 twists per linear foot.

16. The cable of claim 1, wherein the second twist rate of the outer layer is approximately 1.3 twists per linear foot.

17. A cable, comprising:

a) a filler defining a number of pockets;

b) a plurality of inner twisted conductor pairs, each one of the inner twisted conductor pairs being positioned within one of the number of pockets defined by the filler, the filler and the plurality of inner twisted conductor pairs defining a twisted core having a first twist rate; and c) an outer layer of twisted conductor pairs positioned about the twisted core, the outer layer of twisted conductor pairs having a second twist rate, the second twist rate of the outer layer being different than, and in the same direction as, the first twist rate of the twisted core.

18. The cable of claim 17, wherein the filler includes radial extensions that define the number of pockets.

19. The cable of claim 18, wherein the filler includes retaining members located at free ends of the radial extensions, the retaining members being arranged to retain the inner twisted conductor pairs within the pockets of the filler.

20. The cable of claim 19, wherein the retaining members have a length transverse to a length of the radial extensions.

21. The cable of claim 17, wherein each of the inner twisted conductor pairs has a different individual twist rate than the other inner twisted conductor pairs.

22. The cable of claim 21, wherein the different individual twist rates of each of the inner twisted conductor pairs defines a range of twist rates, and wherein the outer twisted conductor pairs of the outer layer each have an individual twist rate, the individual twist rates of the outer twisted conductor pairs being outside the range of twist rates of the inner twisted conductor pairs.

23. The cable of claim 21, wherein the different individual twist rates of the inner twisted conductor pairs have the same twist direction, the direction being only one of a right-handed twist direction and a left-handed twist direction.

24. The cable of claim 23, wherein the first twist rate of the twisted core has the same twist direction as the inner twisted conductor pairs.

25. The cable of claim 21, wherein the different individual twist rates of the inner twisted conductor pairs are between about 27.3 twists per linear foot and 36.8 twists per linear foot.

26. The cable of claim 17, wherein each of the twisted conductor pairs of the outer layer has an individual twist rate, the individual twist rates being between about 12.4 twists per linear foot and 27.0 twists per linear foot.

27. The cable of claim 17, wherein each of the twisted conductor pairs of the outer layer are individually twisted in the same direction, the direction being only one of a right-handed twist direction and a left-handed twist direction.

28. The cable of claim 17, wherein the first twist rate of the twisted core is approximately 4.8 twists per linear foot.

29. The cable of claim 17, wherein the second twist rate of the outer layer is approximately 1.3 twists per linear foot.

30. A method of manufacturing a cable, the method including the steps of:

a) positioning each one of a plurality of inner twisted conductor pairs within a pocket of a filler, the positioned inner twisted conductor pairs and the filler defining an inner core having a circumference;

b) twisting the inner core at an initial twist rate and in a first direction;

c) positioning a number of outer twisted conductor pairs about the circumference of the inner core; and d) twisting the inner core and the outer twisted conductor pairs at a second twist rate, and in the first direction.

31. The method of claim 30, further including individually twisting each of the inner twisted conductor pairs in a twist direction, the direction being only one of a right-handed twist direction and a left-handed twist direction.

32. The method of claim 31, further including twisting each of the inner twisted conductor pairs at a different individual twist rate.

33. The method of claim 32, wherein the step of twisting each of the inner twisted conductor pairs includes twisting each of the inner twisted conductor pairs at a rate of between about 27.3 twists per linear foot and 36.8 twists per linear foot.

34. The method of claim 30, further including individually twisting each of the outer twisted conductor pairs in a twist direction, the direction being only one of a right-handed twist direction and a left-handed twist direction.

35. The method of claim 34, further including twisting each of the outer twisted conductor pairs at an individual twist rate, the individual twist rates being between about 12.4 twists per linear foot and 27.0 twists per linear foot.

36. The method of claim 30, wherein the step of twisting the inner core at an initial twist rate includes twisting the inner core at an initial twist rate of approximately 4 twists per linear foot.

37. The method of claim 36, wherein the step of twisting the inner core and the outer twisted conductor pairs includes twisting the inner core and the outer twisted conductor pairs at a second twist rate of approximately 1.3 twists per linear foot.

* * * * *

UNITED STATES PATENT AND TRADEMARK OFFICE

CERTIFICATE OF CORRECTION

PATENT NO. : 7,173,189 B1
APPLICATION NO. : 11/268681
DATED : February 6, 2007
INVENTOR(S) : Hazy et al.

It is certified that error appears in the above-identified patent and that said Letters Patent is hereby corrected as shown below:

Col. 5, line 42, claim 4: "a left-banded twist" should read --a left-handed twist--

Signed and Sealed this
Twelfth Day of February, 2013

Teresa Stanek Rea
*Acting Director of the United States Patent and Trademark Office*